US008613181B2

(12) United States Patent
Jay et al.

(10) Patent No.: US 8,613,181 B2
(45) Date of Patent: Dec. 24, 2013

(54) APPARATUS AND METHODS FOR INSTALLING A PENETRATION IN A SHEATHING ASSEMBLY

(75) Inventors: Gregory L. Jay, Conyers, GA (US); Steven C. Easley, Danville, CA (US)

(73) Assignee: Georgia-Pacific Wood Products LLC, Atlanta, GA (US)

( * ) Notice: Subject to any disclaimer, the term of this patent is extended or adjusted under 35 U.S.C. 154(b) by 53 days.

(21) Appl. No.: 12/775,627

(22) Filed: May 7, 2010

(65) Prior Publication Data

US 2010/0281787 A1 Nov. 11, 2010

Related U.S. Application Data

(60) Provisional application No. 61/176,425, filed on May 7, 2009.

(51) Int. Cl.
*E04B 1/70* (2006.01)
*E04B 1/62* (2006.01)
*E04B 1/64* (2006.01)

(52) U.S. Cl.
USPC ..... 52/745.15; 52/747.1; 52/506.01; 52/62; 52/58; 52/410

(58) Field of Classification Search
USPC ..... 52/58, 62, 747.1, 745.15, 506.01, 410, 52/408, 409
See application file for complete search history.

(56) References Cited

U.S. PATENT DOCUMENTS

| | | | | |
|---|---|---|---|---|
| 2,228,152 | A * | 1/1941 | Patten | 52/479 |
| 4,490,953 | A * | 1/1985 | Meola | 52/211 |
| 5,367,847 | A * | 11/1994 | Hepler | 52/309.4 |
| 5,374,477 | A * | 12/1994 | Lawless et al. | 428/317.3 |
| 5,586,415 | A * | 12/1996 | Fisher et al. | 52/58 |
| 6,256,956 | B1 * | 7/2001 | Davis | 52/408 |
| 7,669,382 | B2 * | 3/2010 | Burton et al. | 52/745.16 |
| 7,754,304 | B1 * | 7/2010 | Hohmann, Jr. | 428/40.1 |
| 7,874,121 | B1 * | 1/2011 | Hohmann, Jr. | 52/717.01 |
| 2002/0050103 | A1 * | 5/2002 | Ackerman, Jr. | 52/58 |
| 2003/0056444 | A1 * | 3/2003 | Ackerman, Jr. | 52/58 |
| 2004/0020143 | A1 * | 2/2004 | Webb | 52/204.53 |
| 2006/0101726 | A1 * | 5/2006 | Collins | 52/58 |
| 2007/0175107 | A1 * | 8/2007 | O'Rourke | 52/58 |
| 2007/0234667 | A1 * | 10/2007 | Lubker et al. | 52/408 |
| 2008/0141597 | A1 * | 6/2008 | O'Rourke et al. | 52/62 |
| 2008/0178557 | A1 * | 7/2008 | Parsons et al. | 52/741.1 |

* cited by examiner

*Primary Examiner* — Phi A
(74) *Attorney, Agent, or Firm* — Ram W. Sabnis

(57) ABSTRACT

Apparatus and methods for installing a penetration in a sheathing assembly and building structures. An opening can be formed at least partially through a sheathing assembly that includes a body; a barrier layer; and an adhesive disposed between at least a portion of the body and the barrier layer. At least a portion of the barrier layer adjacent the opening can be peeled back to expose at least a portion of the body. A penetration can be disposed at least partially within the opening. The penetration can include a contact member that at least partially contacts the exposed body, the barrier layer, or both. The penetration can be secured to at least a portion of the sheathing assembly, and the peeled back portion of the barrier layer can be repositioned such that the barrier layer covers at least a portion of the contact member.

22 Claims, 6 Drawing Sheets

APPARATUS AND METHODS FOR INSTALLING A PENETRATION IN A SHEATHING ASSEMBLY

CROSS-REFERENCE TO RELATED APPLICATIONS

This application claims priority to U.S. Provisional Patent Application having Ser. No. 61/176,425, filed May 7, 2009, which is incorporated by reference herein.

BACKGROUND OF THE INVENTION

1. Field of the Invention

Embodiments of the present invention generally relate to apparatus and methods for installing construction materials. Embodiments of the present invention further relate to apparatus and methods for installing a penetration at least partially disposed within an opening in a multi-layer wall-sheathing and structures made according thereto.

2. Description of the Related Art

Sheathing is typically installed on the exterior of a building's frame. The sheathing is then usually covered with a protective layer of material ("building wrap") that protects the sheathing and the interior of the building from the outside environment, e.g., air, water, and the like. Often it is desirable to install one or more "penetrations," e.g., windows, vents, pipes, doors, and the like, at least partially within or through the wall of a building, which requires forming an opening through the buildings frame, sheathing, building wrap, and any other layers of material, collectively referred to as the "building's wall." After forming the opening in the building's wall, the penetration, such as a door or window, can be installed.

After installation, the window is typically sealed around the edges of its frame. The window is typically sealed by flashing ("window flashing") that is placed on the frame of the window and the exterior layer of the building. The flashing often provides an incomplete seal around the window.

There is a need, therefore, for improved methods for installing a penetration in a building.

SUMMARY OF THE INVENTION

Methods for installing a penetration in a sheathing assembly and building structures are provided. In at least one specific embodiment, an opening can be formed at least partially through a sheathing assembly that includes a body; a barrier layer; and an adhesive disposed between at least a portion of the body and the barrier layer. At least a portion of the barrier layer adjacent the opening can be peeled back to expose at least a portion of the body. A penetration can be disposed at least partially within the opening. The penetration can include a contact member that at least partially contacts the exposed body, the barrier layer, or both. The penetration can be secured to at least a portion of the sheathing assembly, and the peeled back portion of the barrier layer can be repositioned such that the barrier layer covers at least a portion of the contact member.

In at least one other specific embodiment, the method comprises disposing one or more sheathing assemblies on an exterior side of a frame to provide a supported sheathing assembly; wherein the one or more sheathing assemblies comprise a body; a barrier layer; and an adhesive disposed between at least a portion of the body and the barrier layer; forming an opening at least partially through the supported sheathing assembly; peeling back a portion of the barrier layer adjacent the opening to expose the body; disposing flashing along a portion of the opening, such that the flashing contacts the barrier layer and the frame; disposing a penetration at least partially within the opening, wherein the penetration includes a contact member that at least partially contacts the exposed body, the barrier layer, or both; securing the penetration to the supported sheathing assembly; and repositioning the peeled back portion of the barrier layer, such that the peeled back portion of the barrier layer overlaps at least a portion of the contact member.

A building structure is also provided. In at least one specific embodiment, the building structure can include a framed structure; one or more sheathing assemblies disposed on an exterior side of the framed structure, wherein the one or more sheathing assemblies comprise a body; a barrier layer; and an adhesive disposed between at least a portion of the body and the barrier layer; a penetration at least partially disposed within an opening disposed through the sheathing assembly, wherein the penetration includes a contact member, and wherein at least a portion of the contact member is disposed between the body and the barrier layer.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1A:
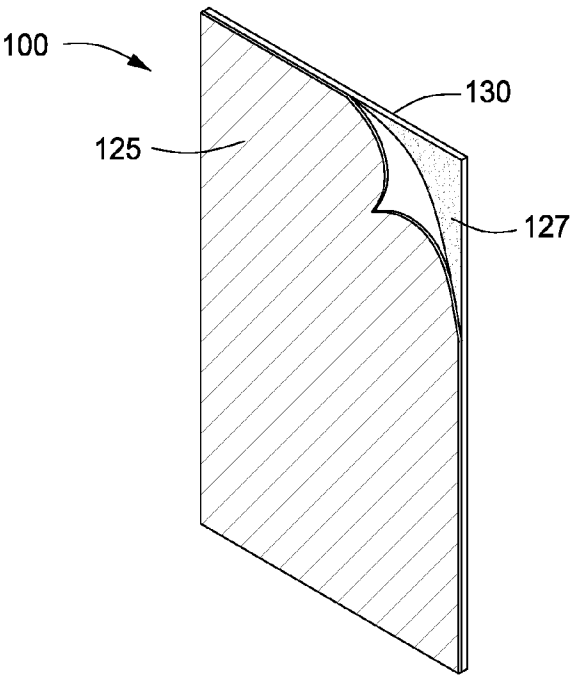
FIG. 1A depicts an isometric view of an illustrative sheathing assembly, according to one or more embodiments described.
Figure 1B:
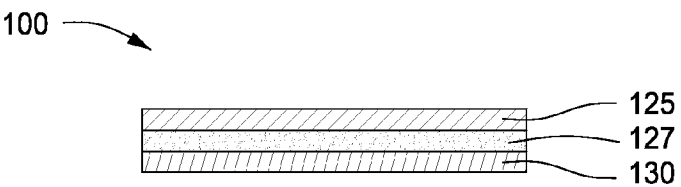
FIG. 1B depicts an illustrative cross-sectional view of the sheathing assembly shown in FIG. 1A.

FIG. 1A depicts an isometric view of an illustrative sheathing assembly 100 and FIG. 1B depicts an illustrative cross-sectional view of the sheathing assembly 100 shown in FIG. 1A, according to one or more embodiments. The sheathing assembly 100 can include two or more layers of material (two are shown 125, 130) that are joined or otherwise secured together using an adhesive layer 127. As shown, an adhesive layer 127 can be at least partially disposed between the first layer or barrier layer 125 and the second layer or body 130. Each layer 125, 130 can be a single layer of material or two or more layers of materials, where the materials of each layer or a portion of each layer is the same or different.

Preferably, the body 130 is made from wood, engineered wood, polymers, fiberglass, carbon fiber, foam, cellulose fiber, gypsum, metal, cement, or any combination thereof. As used herein, the term "wood" includes cellulose fibers and hemicellulose fibers bonded together by a polymer, for example a lignin polymer. As used herein, the term "engineered wood" includes a material that includes wood or a wood product or derivative thereof and one or more other components (e.g., adhesives). The engineered wood can be formed from particles, chips, fibers, veneers, flakes, strands, combinations thereof, and the like, of wood with one or more other components, such as one or more adhesives. Engineered wood can include, but is not limited to, particleboard, fiberboard, waferboard, oriented strand board ("OSB"), plywood, laminated veneer lumber ("LVL") from wood particles, fibers, and/or veneers, and the like. As used herein, the term "polymer" refers to a polymeric material that is a homopolymer or a copolymer. As used herein, the term "homopolymer" refers to a polymeric material that is the reaction product of one monomer. As used herein, the term "copolymer" refers to a polymeric material that is the reaction product of at least two different monomers. One or more polymeric resins can be used as binders for the particles, chips, fibers, veneers, flakes, strands, or the like making up the engineered wood. Illustrative polymeric binders can include, but are not limited to, isocyanate resin, urea-formaldehyde, phenol formaldehyde, melamine formaldehyde, and copolymers thereof. As used herein, the term "foam" includes extruded polystyrene, polyisocyanurate, or a combination thereof.

In one or more embodiments, the body 130 can include two or more layers of material. Each layer of a multi-layer body 130 can be oriented in one or more directions in respect to one another. For example, the body 130 can be or include OSB made from compressed wood arranged in three perpendicular layers bonded with an adhesive, for example phenolic resin. Multi-layer construction of the body 130 can provide dimensional stability, stiffness, and a smooth surface. Commercially available material suitable for the body 130 can include, but is not limited to, Blue Ribbon® OSB Rated Sheathing, Blue Ribbon® Sturd-I-Floor® Sub-floor, Thermostat® OSB Radiant Barrier Sheathing, Thermostat® plywood Radiant Barrier Sheathing, Plytanium® plywood, Plytanium® Sturd-I-Floor® plywood, DensGlass™ exterior sheathing, Dens-Deck® roof boards, each sold by the Georgia-Pacific Corporation.

Considering the barrier layer 125 in more detail, the term "barrier" as used herein, refers to any material that is able to at least partially resist air, water, moisture, light, pests, or any other environmental elements or concerns. The barrier layer 125 can be or include, for example, one or more films, sheets, mats, or any combination thereof. In one or more embodiments, the barrier layer 125 can be or include one or more individual layers of polymer, metal, paper, hydrocarbon (e.g. tar paper), felt, or combinations thereof. The barrier layer 125 can also be referred to as a "building wrap" or "house wrap" that can be applied to the body 130 before the application of a final siding or veneer, e.g., brick, metal, painted wood, stucco, vinyl siding, cellulose fiber reinforced cement boards, Exterior Insulation and Finish System ("EIFS"), and the like. The barrier layer 125 or any individual layer thereof can be woven, non-woven, cross-woven, or any combination thereof. The barrier layer 125 can also be perforated or non-perforated. Perforations can be formed by weaving multiple fibers or strands, mechanical formation of holes, or a combination thereof.

In one or more embodiments, the barrier layer 125 is permeable to vapor, e.g. water vapor. The barrier layer 125 can have a water vapor transmission rate ("WVTR") ranging from a low of about 0.1 US perms, about 0.2 US perms, or about 0.3 US perms to a high of about 50 US perms, about 100 US perms, or about 200 US perms. For example, the barrier layer 125 can have a WVTR of from about 0.15 US perms to about 5 US perms, about 0.25 US perms to about 100 US perms, or about 0.5 US perms to about 0.7 US perms. In another example, the barrier layer 125 can have a maximum WVTR of 0.6 US perms.

The barrier layer 125 can be made of one or more synthetic materials, such as one or more polymers. Suitable polymers can include, but are not limited to, butylene polymer, ethylene polymer, high density polyethylene ("HDPE") polymer, medium density polyethylene ("MDPE") polymer, low density polyethylene ("LDPE") polymer, propylene ("PP") polymer, isotactic polypropylene ("iPP") polymer, high crystallinity polypropylene ("HCPP") polymer, ethylene-propylene ("EP") copolymers, ethylene-propylene-butylene ("EPB") terpolymers, propylene-butylene ("PB") copolymer, an ethylene elastomer, a ethylene-based plastomer, a propylene elastomer, a polyolefin, and combinations or blends thereof. In one or more embodiment, barrier layer 125 can be made of polyolefin yarns coated with a polyolefin plastic coating.

In one or more embodiments, the barrier layer 125 can have a thickness of at least 0.01 mm, at least 0.025 mm, at least 0.05 mm, at least 0.1 mm, at least 0.15 mm, at least 0.2 mm, at least 0.25 mm, at least 0.3 mm, at least 0.35 mm, at least 0.4 mm, at least 0.45 mm, at least 0.5 mm, at least 0.55 mm, at least 0.6 mm, at least 0.65 mm, at least 0.7 mm, at least 0.75 mm, at least 0.8 mm, at least 0.85 mm, at least 0.9 mm, at least 0.95 mm, or at least 1 mm. In one or more embodiments, the thickness of the barrier layer 125 can be less than 0.05 mm, less than 0.1 mm, less than 0.15 mm, less than 0.2 mm, less than 0.25 mm, less than 0.3 mm, less than 0.35 mm, less than 0.4 mm, less than 0.45 mm, less than 0.5 mm, less than 0.55 mm, less than 0.6 mm, less than 0.65 mm, less than 0.7 mm, less than 0.75 mm, less than 0.8 mm, less than 0.85 mm, less than 0.9 mm, less than 0.95 mm, or less than 1 mm. In one or more embodiments, the barrier layer 125 can have a thickness ranging from a low of about 0.05 mm, about 0.15 mm, or about 0.2 mm to a high of about 0.5 mm, about 0.8 mm, or about 1 mm. In one or more embodiments, the barrier layer 125 can have a thickness ranging from a low of about 0.01 mm, about 0.05 mm, or about 0.1 mm to a high of about 0.2 mm, about 0.4 mm, or about 0.5 mm.

In one or more embodiments, the barrier layer 125 or portions thereof can include a non-woven polymer bonded by heat and pressure without a binder. In at least one specific embodiment, the barrier layer 125 can be or include a cross-woven polyolefin wrap with a breathable polyolefin coating that resists water and air in accordance with the International Building, Residential, and Energy Codes when used in conjunction with code-approved tape, e.g., tape sold by the Pactiv Corporation. In another embodiment, the barrier layer 125 can be or include a cross-woven polyolefin wrap without a breathable polyolefin coating that resists water and air. Commercially available barriers 125 can include, but are not limited to GreenGuard® Value Building Wrap™ and GreenGuard® Max Building Wrap™, each sold by the Pactiv Corporation.

The adhesive layer or tie-layer 127 can include, but is not limited to, petroleum-based adhesives, protein-based adhesives, natural rubber adhesives, synthetic rubber adhesives, elastomer adhesives, synthetic adhesives, drying adhesives, contact adhesives, pressure sensitive adhesives ("PSA"), and the like. Illustrative adhesives can include, but are not limited to, polyurethane, polyvinyl alcohol, butyl rubber, polyvinyl acetate ("PVA"), ethylene vinyl acetate (EVA), isocyanate resin, urea-formaldehyde, phenol formaldehyde, melamine formaldehyde, melamine urea formaldehyde, co-polymers thereof, or any combination thereof. Other illustrative PSAs can include, but are not limited to, solvent and latex or water-based PSAs.

Illustrative PSA systems can include, but are not limited to, acrylic and methacrylate adhesives, rubber-based PSAs, styrene copolymer PSAs, and silicone PSAs. Acrylic PSAs can include an acrylate system, such as ethylene ethyl acrylate ("EEA") or ethylene methyl acrylate ("EMA") copolymers.

In one or more embodiments, the adhesive layer 127 can be applied to the body 130, the barrier layer 125, or both by brush, spray coating, roll coating, or the like. In one or more embodiments, the amount of adhesive can range from a low of about 0.001 $kg/m^2$, about 0.01 $kg/m^2$, about 0.05 $kg/m^2$, about 0.075 $kg/m^2$, or about 0.1 $kg/m^2$ to a high of about 0.2 $kg/m^2$, about 0.25 $kg/m^2$, about 0.3 $kg/m^2$, about 0.35 $kg/m^2$, about 0.4 $kg/m^2$, about 0.5 $kg/m^2$, about 0.6 $kg/m^2$, about 0.7 $kg/m^2$, or about 0.8 $kg/m^2$. For example, about 0.08 $kg/m^2$, about 0.1 $kg/m^2$, about 0.13 $kg/m^2$, about 0.15 $kg/m^2$, or about 0.17 $kg/m^2$ of adhesive can be used.

In one or more embodiments, the peel strength between the barrier layer 125 and the body 130 can be at least 0.0009 kgf/cm, at least 0.0015 kgf/cm, at least 0.003 kgf/cm, at least 0.015 kgf/cm, at least 0.03 kgf/cm, at least 0.045 kgf/cm, at least 0.06 kgf/cm, at least 0.09 kgf/cm, at least 0.15 kgf/cm, at least 0.18 kgf/cm, at least 0.21 kgf/cm, at least 0.24 kgf/cm, at least 0.27 kgf/cm, at least 0.3 kgf/cm, at least 0.6 kgf/cm, at least 0.9 kgf/cm, at least 1.2 kgf/cm, or at least 1.5 kgf/cm. The peel strength can be less than 3 kgf/cm, less than 2.2 kgf/cm, less than 1.5 kgf/cm, less than 0.75 kgf/cm, less than 0.45 kgf/cm, less than 0.3 kgf/cm, less than 0.27 kgf/cm, less than 0.24 kgf/cm, less than 0.21 kgf/cm, less than 0.18 kgf/cm, less than 0.12 kgf/cm, less than 0.06 kgf/cm, or less than 0.03 kgf/cm. In one or more embodiments, the peel strength can range from a low of about 0.0009 kgf/cm, about 0.003 kgf/cm, or about 0.09 kgf/cm to a high of about 0.15 kgf/cm, about 0.21 kgf/cm, or about 0.45 kgf/cm. In one or more embodiments, the peel strength can range from a low of about 0.0009 kgf/cm, about 0.015 kgf/cm, or about 0.15 kgf/cm to a high of about 0.18 kgf/cm, about 0.5 kgf/cm, or about 0.65 kgf/cm. In one or more embodiments, the peel strength can range from a low of about 0.0009 kgf/cm, about 0.03 kgf/cm, or about 0.2 kgf/cm to a high of about 0.27 kgf/cm, about 0.48 kgf/cm, or about 0.9 kgf/cm. In one or more embodiments, the peel strength can range from a low of about 0.0009 kgf/cm, about 0.002 kgf/cm, or about 0.03 kgf/cm to a high of about 0.04 kgf/cm, about 0.1 kgf/cm, or about 0.16 kgf/cm. The peel strength can be determined using any standard test, such as the ASTM D6862 Standard Test Method for 90° Angle Resistance of Adhesives.

Although not shown in FIGS. 1A and 1B, the sheathing assembly 100 can further include an edge seal or edge coating disposed thereabout. The edge coating can reduce or prevent water and/or air from penetrating into the edges of the sheathing assembly 100. The edge coating can include one or more paints, pastes, lacquers, laminates, waxes, gels, glues, epoxies, tapes, polymeric materials, resins, or any combination thereof.

In one or more embodiments, any of the layers 125, 127, 130 or portions thereof can include one or more additives. As used herein, the term "additive" can include, but is not limited to, one or more opacifying agents, pigments, colorants, cavitating agents, slip agents, antioxidants, anti-fog agents, antistatic agents, fillers, moisture barrier additives, gas barrier additives, fire retardant additives, and combinations thereof. Such additives can be used in effective amounts, which vary depending upon the property required.

Figure 2:
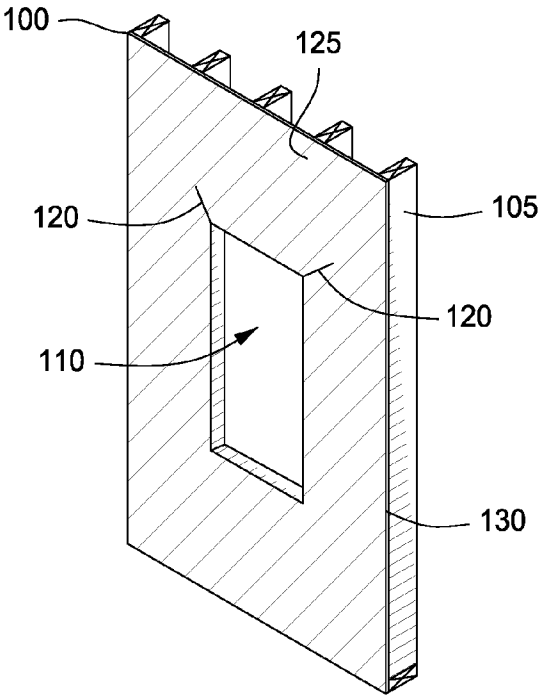
FIG. 2 depicts an illustrative isometric view of the sheathing depicted in FIGS. 1A and 1B disposed on a framed construction, according to one or more embodiments described.

FIG. 2 depicts an isometric view of the sheathing assembly 100 shown in FIGS. 1A and 1B disposed on a frame 105 having an opening 110 formed therethrough and two scoring lines 120 disposed in the barrier layer 125 of the sheathing assembly 100, according to one or more embodiments. In one or more embodiments, one or more openings 110 can be at least partially formed through the sheathing assembly 100. Although not shown, the opening 110 can be a recessed area partially disposed within the sheathing assembly 100 such that a groove, indentation or other recessed area is formed in the sheathing assembly 100. The opening 110 can be formed in the sheathing assembly 100 using any suitable device, such as a saw or drill, and can be any shape and any dimension. The opening 110 can be shaped and sized to correspond to the shape and size of a penetration (discussed in more detail below with reference to FIG. 5), which can be at least partially disposed within the opening 110. Illustrative shapes of the opening 110 can include, but are not limited to, rectangles, circles, half-circles, triangles, ovals, any other geometrical shapes, or any combination thereof. As illustrated, the opening 110 can be a rectangular opening disposed through the sheathing assembly 100 having two sides oriented vertically relative to one another and two sides oriented horizontally relative to one another.

In one or more embodiments, one or more cuts or scored lines 120 (two are shown) can be disposed in the barrier layer 125. The scored lines 120 can partially or completely penetrate the barrier layer 125. The scored lines 120 can penetrate through the barrier layer 125 and partially into the body 130. The scored lines 120 can be a continuous score, a series of regular or irregular scores along the length thereof, or a combination thereof.

The scored lines 120 can facilitate or otherwise improve the separation of a predetermined portion of the barrier layer 125 from the body 130. The scored lines 120 can be formed at any suitable angle or combination of angles relative to the opening 110. As illustrated in FIG. 2, the scored lines 120 can be disposed through the barrier layer 125 and can extend from the corners of the rectangular opening 110 at an angle of about 45°. The scored lines 120 can extend any suitable distance from the opening 110. For example, the scored lines 120 can extend from the opening a distance of from about 1 cm, about 5 cm, about 10 cm, about 15 cm, about 20 cm, or about 25 cm or more. In one or more embodiments, the scored lines 120 can be linear (as shown), non-linear (not shown), or a combination thereof.

In one or more embodiments, one or more sheathing assemblies 100 (one is shown) can be disposed on a frame 105 or other support member to provide a supported sheathing assembly 100. The frame 105 can be or include, but is not limited to, a wood frame, metal frame, concrete or cement frame, cinder block frame, or any combination thereof. The frame 105 can be configured to provide an enclosed structure such as a house, garage, trailer, or other residential structure. The frame 105 can be configured to provide an enclosed structure such as a commercial building, warehouse, storage building, or any other commercial structure. The sheathing assembly 100 can be disposed about a portion of the frame 105 or the entire frame 105 to provide an enclosed structure. The sheathing assembly 100 can be disposed about the frame 105 with the barrier layer 125 oriented toward the outside, i.e., away from the frame 105. In other words, the body 130 of the sheathing assembly 100 can be oriented toward and/or can at least partially contact the frame 105. The sheathing assembly 100 can provide or otherwise make up a portion of a building structure's wall, roof, and/or floor.

In one or more embodiments, a plurality of sheathing assemblies 100 can be disposed on the frame 105 such that each sheathing assembly 100 is spaced apart. For example, a gap of about 1 mm, about 2 mm, about 3 mm, about 4 mm, or about 5 mm or more can be provided between adjacent sheathing assemblies 100. In one or more embodiments, tape can be disposed along each seam or gap between the one or more sheathing assemblies 100. The tape can provide a water and/or air resistant seal. Illustrative tapes can include, but are not limited to, building code compliant tapes, such as those sold by the Pactiv Corporation and/or the Georgia Pacific Corporation.

Figure 3:
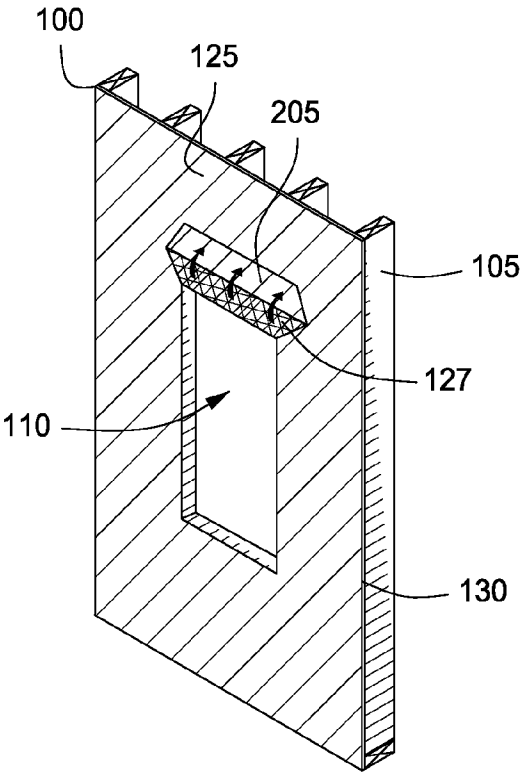
FIG. 3 depicts an illustrative isometric view of the sheathing assembly 100 shown in FIG. 2 with a portion of a barrier layer peeled back, exposing a body thereof, according to one or more embodiments described.

FIG. 3 depicts an isometric view of the sheathing assembly 100 shown in FIG. 2 with a portion 205 of the barrier layer 125 peeled back along the scored lines 120 exposing the body 130 and a portion of the adhesive 127 disposed between the barrier layer 125 and the body 130, according to one or more embodiments. The adhesive disposed between the barrier layer 125 and the body 130 can include one or more properties that permit or otherwise allow the barrier layer 125 to be peeled back and separated from the body 130. The adhesive disposed between the barrier layer 125 and the body 130 can provide a sufficient bond between the two, but upon the application of force, the strength of the bond can be overcome and the barrier layer 125 can be separated from the body 130. In one or more embodiments, the adhesive disposed between the barrier layer 125 and the body 130 can be "de-activated" such that the adhesive releases the barrier layer 125 from the body 130 upon application of one or more external triggers. For example, the adhesive disposed between the barrier layer 125 and the body 130 can release the barrier layer 125 from the body 130 upon introduction of a temperature change (decrease or increase), electromagnetic energy, acoustic energy, pressure, or any combination thereof.

The peeled back portion 205 can be held in position and away from the body 130 using tape, tacks, staples, or any other suitable retainer. In one or more embodiments, the peeled back portion 205 can remain peeled back from the body 130 without the use of any retainer. In one or more embodiments, a person can hold the peeled back portion 205 away from the body 130 and, after a predetermined time or event has occurred, the person can release the peeled back portion 205 allowing the peeled back portion 205 to reposition toward the body 130. For example, an event that could signal the person to release the peeled back portion 205 could be the installation of a penetration (see FIGS. 6-11) at least partially into the opening 110.

Although not shown, prior to forming the opening 110 the barrier layer 125 can be peeled back from at least a portion of the sheathing assembly 100 located where the opening 110 is to be at least partially formed therethrough. For example, prior to forming the rectangular opening 110 illustrated in FIG. 2, scoring lines (not shown) can be cut partially around and/or within the perimeter of the opening 110 to be formed. For example, two diagonal scoring lines can be disposed in the barrier layer 125 that run from the two sets of diagonally opposed corners of the rectangular opening 110 to be formed through the sheathing assembly 100. After the two diagonal scoring lines are cut, four triangular pieces or portions of the barrier layer 125 can be peeled back to expose the body 130. The opening 110 can then be at least partially disposed through the body 130 leaving the barrier layer 125 available for later placement around the one or more penetrations 500 (see FIG. 6). In another example, a vertical scoring line can be disposed length wise along the center portion of the rectangular opening 110 to be formed in the sheathing assembly 100. Scoring lines can also be disposed along the ends of the opening that run from the vertical scoring line to the corners. After the scoring lines are disposed in the barrier layer 125 two flaps or portions of the barrier layer 125 can be peeled back to expose the body 130.

Figure 5:
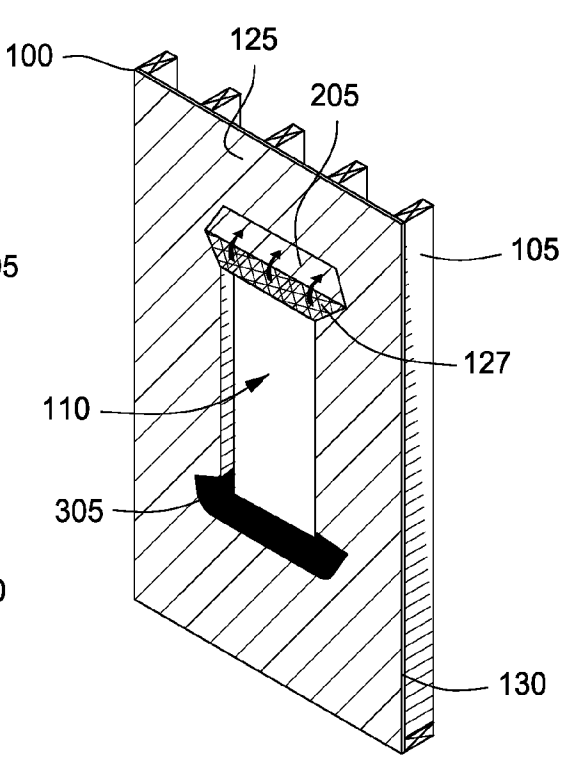
FIGS. 4 through 11 depict an illustrative sequence, according to one or more embodiments described, for installing a window in the framed construction depicted in FIG. 2.
Figure 4:
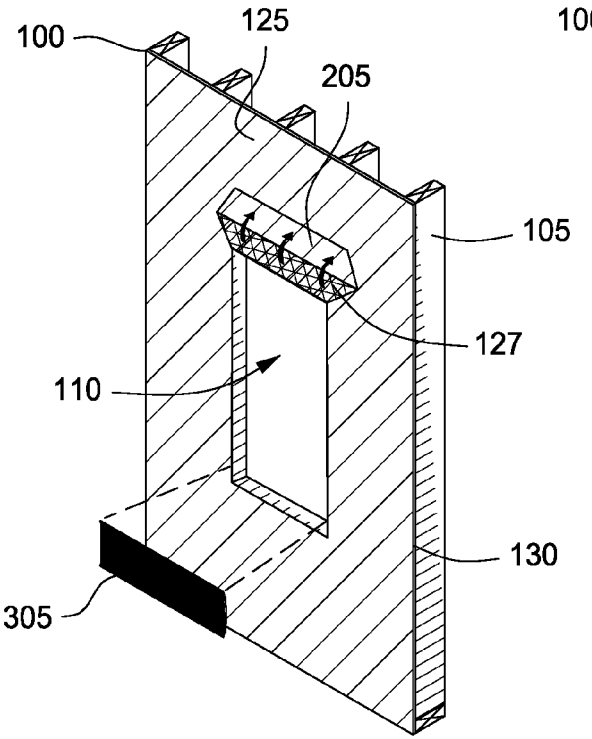

FIG. 4 depicts an isometric view of the sheathing assembly 100 shown in FIG. 3 with a first piece of flashing 305 to be installed about a portion of the opening 110, according to one or more embodiments. FIG. 5 depicts an isometric view of the sheathing assembly 100 shown in FIG. 4 with the first piece of flashing 305 installed about a portion of the opening 110, such that the first piece of flashing 305 covers a portion of the sheathing assembly 100 and a portion of the frame 105, according to one or more embodiments. The first piece of flashing 305 can be disposed such that the first piece of flashing 305 continuously covers from a portion of the frame 105 to the sheathing assembly 100 providing a water and air resistant barrier therebetween.

In addition to completely covering an entire edge of the opening 110 (i.e., both the body 130 and the barrier layer 125 along the edge of the opening 110), the first piece of flashing 305 can at least partially cover one or more additional edges or sides of the opening 110. For example, the first piece of flashing 305 partially covers a portion of both vertical edges of the opening 110 in addition to the complete coverage of the horizontal edge of the opening 110. Such arrangement of the first piece of flashing 305 can commonly be referred to as a window sill flashing, which can be installed prior to disposing a penetration 500 (see FIG. 6) at least partially within the opening 110.

Figure 6:
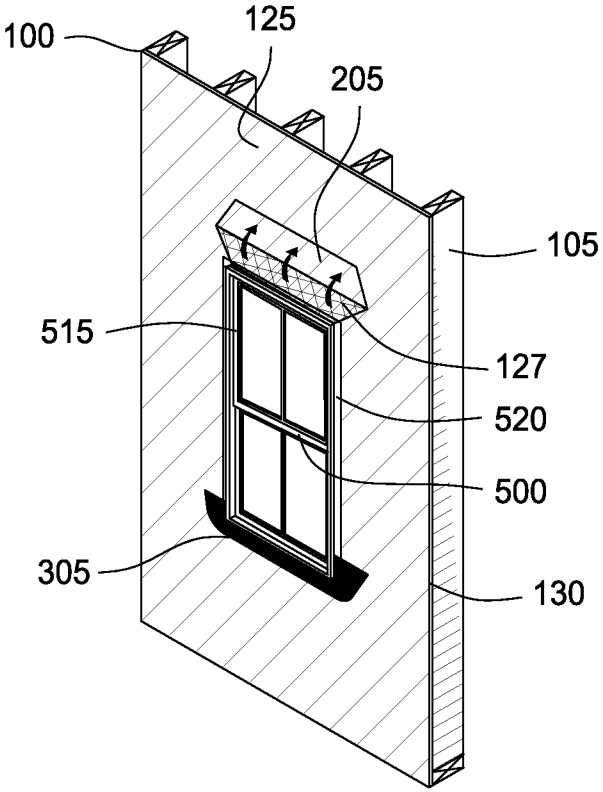

FIG. 6 depicts an isometric view of the sheathing assembly 100 shown in FIG. 5 with a penetration 500 at least partially disposed through the opening 110 (see FIGS. 2-5), according to one or more embodiments. As illustrated, the penetration 500 is a window, but any desired penetration can be at least partially disposed within the opening 110. As used herein, the term "penetration" refers to any structure that can at least partially penetrate the opening 110. Illustrative penetrations 500 can include, but are not limited to, windows and/or window frames, doors and/or door frames, chimneys, cables, wires, pipes, ducts, exhaust fans, exhaust vents, mail boxes, mail box slots, central air conditioning lines and/or tubing, electrical boxes or outlets, light fixtures, speaker fixtures, skylights, and the like.

The penetration 500 can be disposed at least partially within the opening 110, such that the first piece of flashing 305 is disposed toward a first end of the penetration 500. A second end, opposed to the first end of the penetration 500 can be disposed toward the edge of the opening 110 where the body 130 has been exposed. As such, the second end of the penetration 500 can be at least partially in direct contact with the body 130.

In one or more embodiments, the penetration 500 can include a frame 515, e.g., a window frame that includes a flange or trim ("contact member") 520 that can directly contact the body 130. The contact member 520 can extend from the penetration and provide one or more contact points, which can contact the sheathing assembly 100. As illustrated, the contact member 520 can be a continuous flange or trim that extends continuously around the perimeter of the penetration 500. In one or more embodiments, the contact member 520 can include one or more individual or discrete flanges or tabs that periodically or randomly extend from the penetration 500. The contact member 520 can prevent the penetration 500 from passing completely through the opening 110. In other words, the contact member 520 can be or otherwise provide a stop that allows the penetration 500 to at least partially occupy the opening 110 while simultaneously preventing the penetration 500 from passing completely through the opening 110.

The penetration 500 can be secured to the sheathing assembly 100 using any suitable fastener or combination of fasteners. The one or more fasteners can be disposed through or about the contact member 520, through or about the sheathing assembly 100, and/or between the contact member 520 and the sheathing assembly 100 to either temporarily or permanently secure the penetration 500 at least partially within the opening 110. Illustrative fasteners can include, but are not limited to, screws, nails, rivets, bolts, bolts and nuts, staples, tacks, adhesives, caulk, tapes, or any combination thereof. In one or more embodiments, the penetration 500 can be secured to the sheathing assembly 100 at least in part by pressure fit between the edges of the opening 110 and the penetration 500. In one or more embodiments, the penetration 500 can be secured to the sheathing assembly 100 by pressure fit and one or more fasteners. For example, one or more screws can be disposed through the contact member 520 and secured into the sheathing assembly 100 and at least a portion of the edge of the opening 110 can provide a pressure fit against at least a portion of the penetration 500. In one or more embodiments, the penetration 500 can be secured to the sheathing assembly 100 by disposing one or more adhesives, caulks, or the like between the contact member 520 and the sheathing assembly 100. In one or more embodiments, the penetration 500 can be secured using one or more fasteners disposed through the contact member 520 and into or about the sheathing assembly 100 and one or more adhesives, calks, or the like can also be disposed between the contact member 520 and the sheathing assembly 100.

Figure 7:
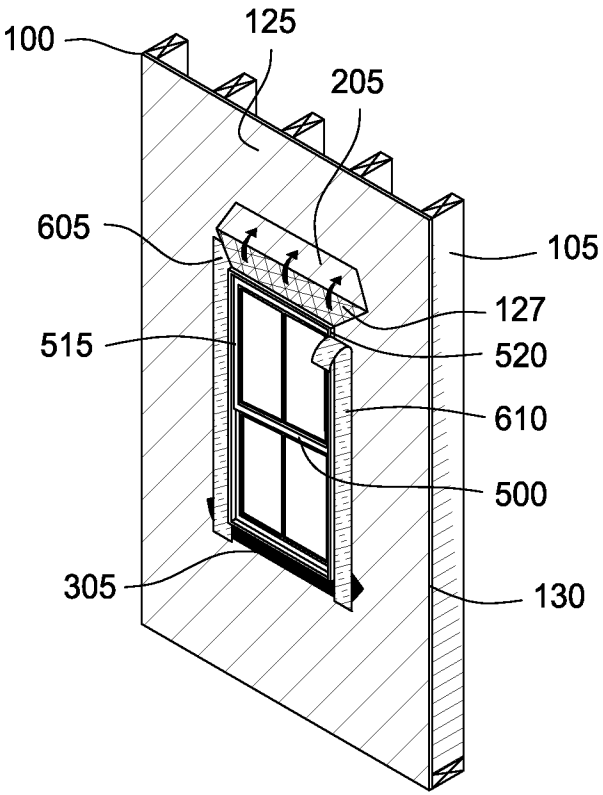

FIG. 7 depicts an isometric view of the sheathing assembly 100 shown in FIG. 6 with a second and third piece of flashing (605 and 610, respectively) disposed about a portion of the penetration 500 and the sheathing assembly 100, such that the second and third pieces of flashing 605, 610 cover a portion of the first piece of flashing 305, a portion of the penetration 500, and a portion of the sheathing assembly 100, according to one or more embodiments. In at least one specific embodiment, a portion of the second and third pieces of flashing 605, 610 can cover a portion of the body 130 exposed by peeling back the portion 205 of the barrier layer 125. The second and third pieces of flashing 605, 610 can be disposed on the sheathing assembly 100 and over the contact member 520 adjacent the vertical edges of the penetration 500. Covering the contact member 520 and the sheathing assembly 100 with the second and third pieces of flashing 605, 610 can provide a water and/or air resistant seal between the penetration 500 and the sheathing assembly 100.

Figure 8:
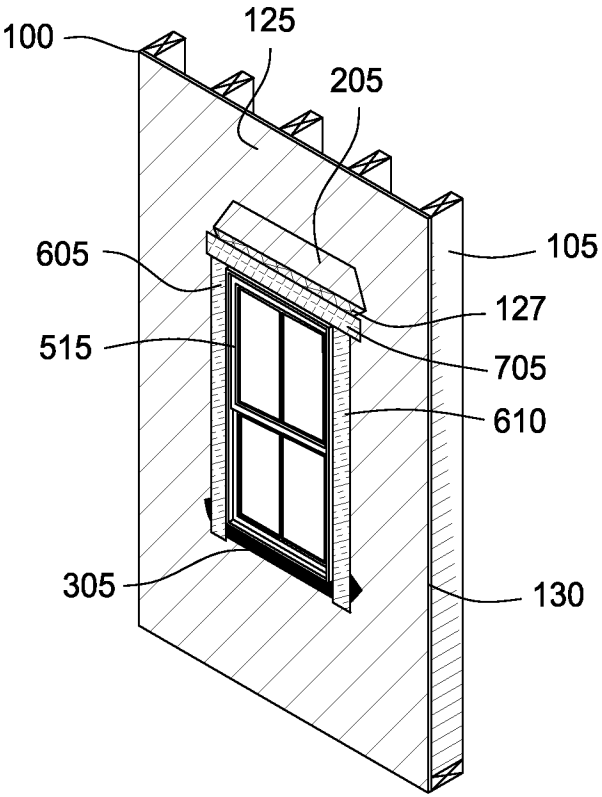

FIG. 8 depicts an isometric view of the sheathing assembly 100 shown in FIG. 7 with a fourth piece of flashing 705 installed about a portion of the penetration 500 at least partially disposed within the opening 110, according to one or more embodiments. The fourth piece of flashing can cover a portion of the second and third pieces of flashing 605, 610, a portion of the penetration 500, a portion of the body 130, and a portion of the sheathing assembly 100. The fourth piece of flashing 705 can be disposed on the body 130 exposed by peeling back the portion 205 of the barrier layer 125 and over the contact member 520 adjacent the upper horizontal edge of the penetration 500.

Although not shown, in one or more embodiments the second piece of flashing 605, the third piece of flashing 610, the fourth piece of flashing 705, or any combination thereof can be disposed about the opening 110 prior to at least partially disposing the penetration 500 within the opening 110. Should the second piece of flashing 605, third piece of flashing 610, and/or fourth piece of flashing 705 be disposed about the edges of the opening 110 prior to at least partially disposing the penetration 500 within the opening 110, additional pieces of flashing can be disposed about the penetration 500 and the sheathing assembly 100.

In addition to or in lieu of the first piece of flashing 305, second piece of flashing 605, third piece of flashing 610, and/or the fourth piece of flashing 705 one or more caulks, foams, gaskets, or any other seal or sealant can be disposed about the edges of the opening 110, the penetration 500, or both. As discussed and described above with reference to FIG. 2, prior to forming the opening 110, the barrier layer 125 can be peeled back from at least a portion of the sheathing assembly 100 located where the opening 110 is to be at least partially formed therethrough. Should a portion of the barrier layer 125 be peeled back prior to forming the opening 110, at least a portion of the peeled back layer 125 can be disposed about the penetration 500 after the penetration 500 is at least partially disposed within the opening 110. For example, the second piece of flashing 605, third piece of flashing 610, and/or the fourth piece of flashing 705 can be disposed about the sheathing assembly 100 and the penetration 500 and then the peeled back barrier layer 125 can then be at least partially disposed about the penetration 500.

The flashing (305, 605, 610, and/or 705) can be a flexible, water resistant and/or waterproof material. The flashing (305, 605, 610, and/or 705) can be, but is not limited to, sheet metal flashing, vinyl flashing, tape flashing, foam flashing, coated paper, or combinations thereof. Sheet metal flashing can be aluminum, copper, zinc, stainless steel, and/or galvanized steel. Vinyl flashing can include polyvinyl chloride, for example. In one or more embodiments, the flashing (305, 605, 610, and/or 705) can include an adhesive disposed thereon, such that the flashing can be secured about the opening 110. In one or more embodiments, the flashing (305, 605, 610, and/or 705) can be secured about the opening using one or more fasteners, for example nails, screws, or the like. Tape flashing can include a self-adhering membrane composed of a high density, cross laminated polyethylene film coated on one side with a layer of rubberized asphalt or other suitable adhesive.

Figure 9:
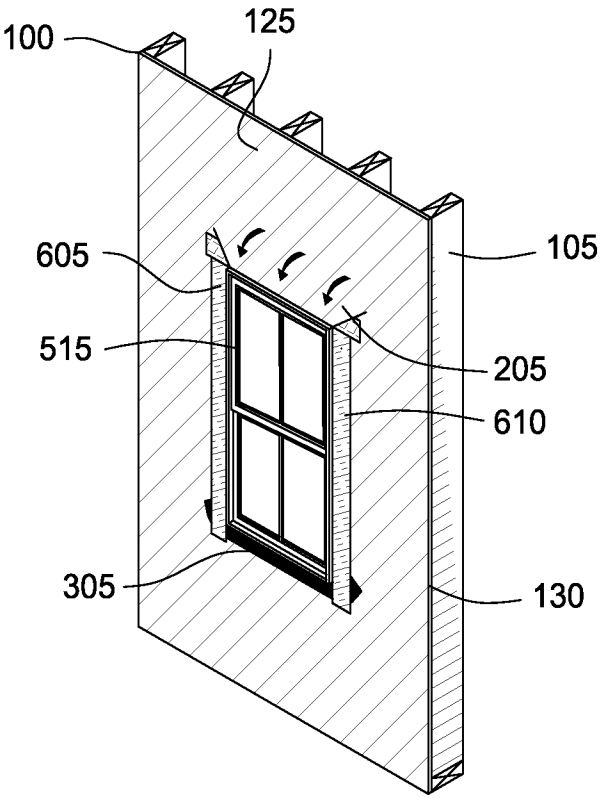

FIG. 9 depicts an isometric view of the sheathing assembly 100 shown in FIG. 8 with the portion 205 of the peeled back barrier layer 125 repositioned such that the barrier layer 125 overlaps or otherwise covers at least a portion of the fourth piece of flashing 705, according to one or more embodiments. In addition to the fourth piece of flashing 705, the portion 205 of the peeled back barrier layer 125 can provide an additional layer of protection against water and/or air when the portion 205 is repositioned onto the fourth piece of flashing 705. The portion 205 of the peeled back barrier layer 125 can be secured to the fourth piece of flashing 705 and/or the body 130 using any suitable fastener and/or adhesive, for example.

Figure 10:
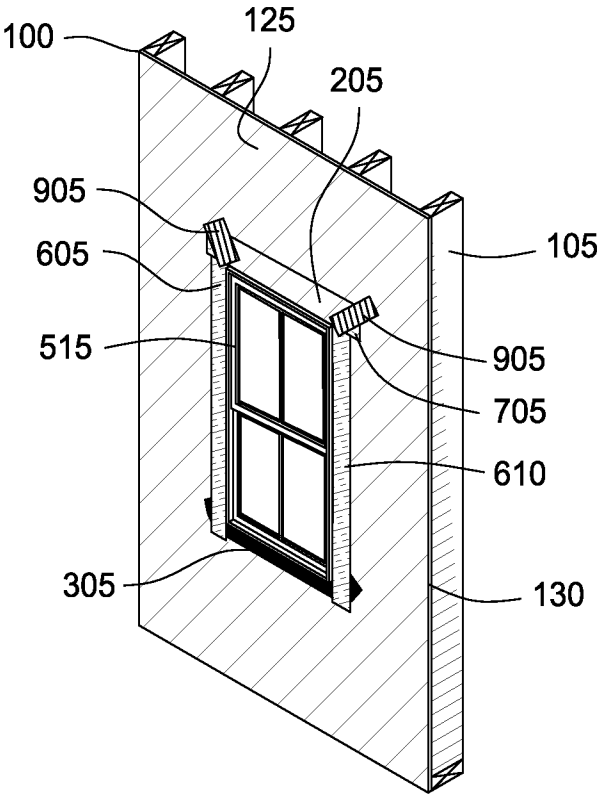

FIG. 10 depicts an isometric view of the sheathing assembly 100 shown in FIG. 9 with two pieces of tape or flashing 905 disposed over the two scoring lines depicted in FIG. 2, according to one or more embodiments. The pieces of tape 905 can be water and/or air resistant tape that can provide an air and/or water resistant covering over the scoring lines 120. In one or more embodiments, epoxy, caulk, or other seal and/or sealants can be used in addition to or in lieu of the pieces of tape 905 to provide an air and/or water seal about the scoring lines 120. In one or more embodiments, the pieces of tape 905 can be or include flashing.

Figure 11:
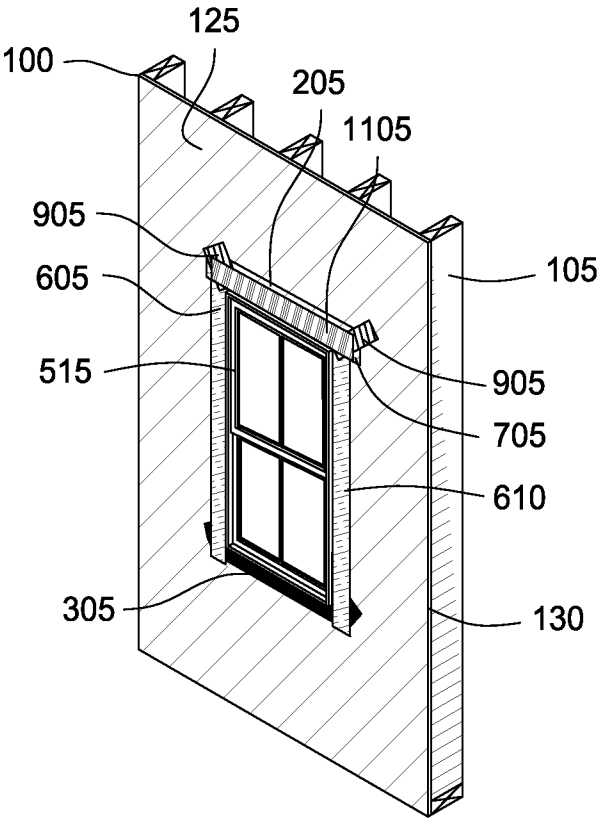

FIG. 11 depicts an isometric view of the sheathing assembly 100 shown in FIG. 10 with a piece of tape or flashing 1105 disposed over a portion of the two pieces of tape 905 and the portion 205 of repositioned barrier layer 125. The tape 1105 can provide additional protection against water and/or air penetration. In one or more embodiments, epoxy, caulk, or other seal and/or sealants can be used in addition to or in lieu of the tape 1105 to provide an air and/or water seal.

Figure 12:
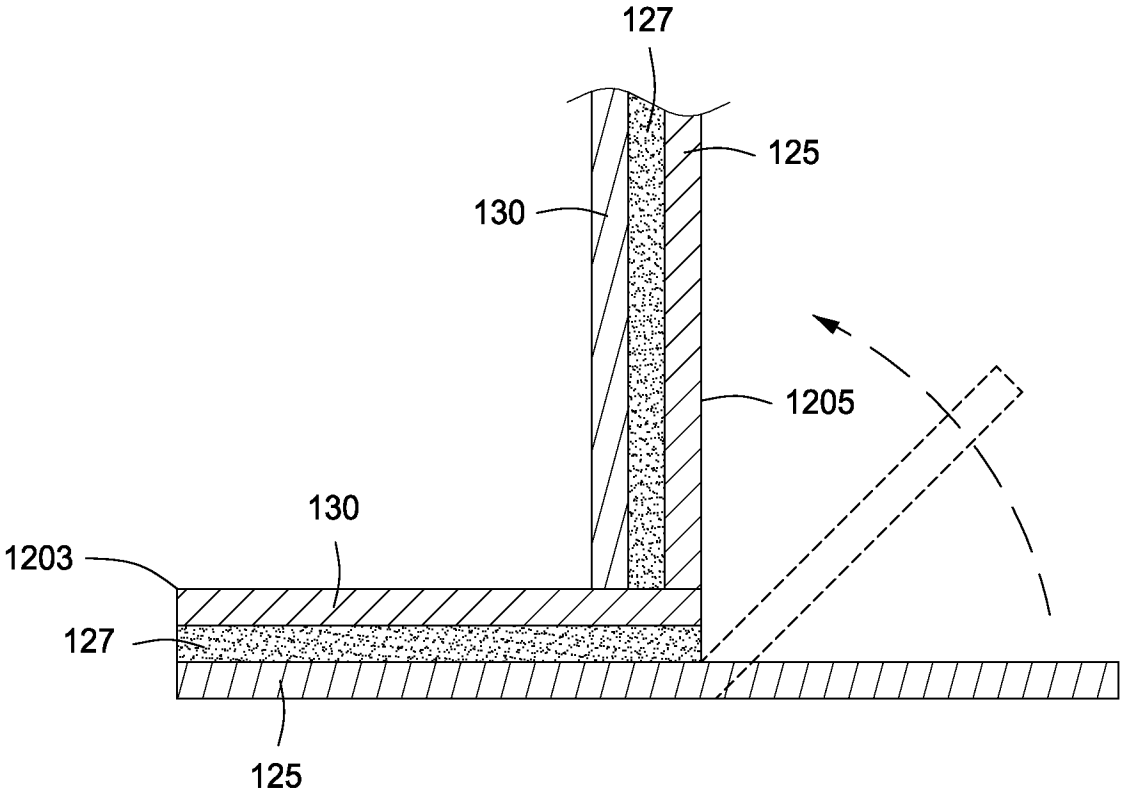
FIG. 12 depicts a top view of two illustrative sheathing assemblies oriented at 90° with respect to one another, according to one or more embodiments described.

FIG. 12 depicts a top view of two illustrative sheathing assemblies (1203, 1205) oriented at 90° with respect to one another, according to one or more embodiments. The sheathing assemblies 1203, 1205 can be similar to the sheathing assembly 100 discussed and described above with reference to FIGS. 1-11. In one or more embodiments, a portion of the barrier layer 125 can be peeled back from the body 130 and the body 130 can be cut or otherwise separated from the sheathing assembly 1203. An edge of the portion of the body 130 remaining with the sheathing assembly 1203 can be placed proximate an end of the sheathing assembly 1205, for example at a 90° angle and secured thereto. For example, the sheathing assemblies 1203, 1205 can be located at the corner of a framed structure (not shown). The portion of the barrier layer 125 that was peeled back from the portion of the body 130 removed from sheathing assembly 1203 can then be wrapped around the corner formed by the sheathing assemblies 1203, 1205. Wrapping a portion of the barrier layer 125 from body 1203 around the corner or joint formed between the two sheathing assemblies 1203, 1205 can provide a water and/or air resistant seal or barrier about the corner. The portion of the barrier layer 125 of sheathing assembly 1203 that can be folded around the joint or corner can be secured to sheathing assembly 1205 using an adhesive, tacks, nails, staples, tape, or any other suitable fastener.

Although not shown, the two sheathing assemblies 1203, 1205 can be jointed together at any suitable angle with respect to one another. For example, sheathing assemblies 1203, 1205 can be joined or positioned together at an angle ranging from 0° (linearly joined end to end) to 180° (stacked on top of one another). In one or more embodiments, the joint provided between the sheathing assemblies 1203, 1205 can be located at any location about a structure, for example a corner, a roof seam or joint, a floor seam or joint, a wall seam or joint, and the like.

In any of the embodiments described herein, the barrier layer 125 can include an anti-skid coating or skid resistant surface to reduce the likelihood of a person slipping should one or more of sheathing assemblies 100 be used as roof decking The skid resistant surface can include texturing the barrier layer 125. The skid resistant surface can include one or more patterns made by embossing, debossing, scoring, or any other method that alters the texture of the barrier layer 125. The skid resistant surface can include a plurality of protrusions extending from the barrier layer 125. The skid resistant surface can include a plurality of depressions formed in the barrier layer 125 such that the depressions provide a suction effect when walked on. In one or more embodiments, the skid resistant surface can remain skid resistant when wet.

In any of the embodiments described herein, the sheathing assembly 100 can include one or more radiant barriers disposed thereon. The radiant barrier can be disposed on the side of the body 130 opposite the barrier layer 125. The radiant barrier can be disposed on the barrier layer 125. The radiant barrier can be disposed between the barrier layer 125 and the body 130. The radiant barrier can be or include one or more layers of a radiant barrier sheet, such as metal foil, for example aluminum foil. The radiant barrier can be affixed to the body 130 of the sheathing assembly 100 using one or more adhesives. The radiant barrier can be or include one or more layers of a sprayed on coating that reduces the transfer of radiant energy therethrough. Illustrative commercially available spray on radiant barriers can include a water-based paint called HeatBloc-75 available from STS Coatings and/or Radiance® available from BASF®.

In another embodiment the present invention relates to:

1. A method for installing a penetration in a sheathing assembly, the sheathing assembly comprising: forming an opening at least partially through a sheathing assembly, comprising: a body; a barrier layer; and an adhesive disposed between at least a portion of the body and the barrier layer; peeling back at least a portion of the barrier layer adjacent the opening to expose at least a portion of the body; disposing a penetration at least partially within the opening, wherein the penetration includes a contact member that at least partially contacts the exposed body, the barrier layer, or both; securing the penetration to at least a portion of the sheathing assembly; and repositioning the peeled back portion of the barrier layer such that the barrier layer covers at least a portion of the contact member.

2. The method according to paragraph 1, wherein the opening is formed completely through the sheathing assembly.

3. The method according to paragraphs 1 or 2, wherein the body comprises wood, engineered wood, or a combination thereof.

4. The method according to any one of paragraphs 1 to 3, wherein the body comprises oriented strand board.

5. The method according to any one of paragraphs 1 to 4, wherein the barrier layer comprises a cross-woven polyolefin wrap that provides a water and air resistant barrier.

6. The method according to any one of paragraphs 1 to 5, wherein the penetration includes a pipe, window frame, door frame, chimney, cable, wire, duct, exhaust fan, exhaust vent, mail box, mail box slot, central air conditioning line, central air conditioning tubing, electrical box, electrical outlet, light fixture, speaker fixture, skylight, or any combination thereof.

7. The method according to any one of paragraphs 1 to 6, wherein peeling back the barrier layer includes scoring the barrier layer in two or more locations to provide a section of the barrier layer that is to be peeled back.

8. The method according to any one of paragraphs 1 to 7, further comprising disposing flashing along at least a portion of the contact member and the barrier layer, such that the flashing covers at least a portion of the contact member and the barrier layer.

9. The method according to any one of paragraphs 1 to 8, further comprising disposing the sheathing assembly on a frame structure, wherein the body faces the frame structure.

10. The method according to any one of paragraphs 1 to 9, further comprising disposing flashing along at least a portion of the opening, such that the flashing covers at least a portion of the frame structure and the barrier layer; disposing flashing along at least a portion of the contact member and the barrier layer, such that the flashing covers at least a portion of the contact member and the barrier layer; and disposing flashing along at least a portion of the contact member and the exposed body, such that the flashing covers at least a portion of the contact member and the exposed body; or any combination thereof.

11. The method according to any one of paragraphs 1 to 10, wherein the sheathing assembly is oriented such that the barrier layer faces toward the exterior of the frame structure.

12. The method of according to any one of paragraphs 1 to 11, wherein the penetration is at least partially disposed within the opening before the portion of the barrier layer is peeled back.

13. A method for installing a penetration in a sheathing assembly, comprising: disposing one or more sheathing assemblies on an exterior side of a frame to provide a supported sheathing assembly, wherein the one or more sheathing assemblies comprise: a body; a barrier layer; and an adhesive disposed between at least a portion of the body and the barrier layer; forming an opening at least partially through the supported sheathing assembly; peeling back a portion of the barrier layer adjacent the opening to expose the body; disposing flashing along a portion of the opening, such that the flashing contacts the barrier layer and the frame; disposing a penetration at least partially within the opening, wherein the penetration includes a contact member that at least partially contacts the exposed body, the barrier layer, or both; securing the penetration to the supported sheathing assembly; and repositioning the peeled back portion of the barrier layer, such that the peeled back portion of the barrier layer overlaps at least a portion of the contact member.

14. The method according to paragraph 13, further comprising scoring the barrier layer at one or more locations prior to peeling back the portion of the barrier layer.

15. The method according to paragraphs 13 or 14, further comprising disposing one or more pieces of tape along the one or more scored locations.

16. The method according to any one of paragraphs 13 to 15, further comprising disposing one or more pieces of flashing about the penetration and the supported sheathing assembly, such that at least a portion of the flashing covers at least a portion of the contact member, the exposed body, or both.

17. The method according to any one of paragraphs 13 to 16, further comprising disposing one or more pieces of flashing about the penetration and the supported sheathing assembly, such that at least a portion of the flashing covers at least a portion of the contact member, the barrier layer, or both.

18. The method according to any one of paragraphs 13 to 17, wherein the penetration is at least partially disposed within the opening before the portion of the barrier layer is peeled back.

19. A building structure, comprising: a framed structure; one or more sheathing assemblies disposed on an exterior side of the framed structure, wherein the one or more sheathing assemblies comprise: a body; a barrier layer; and an adhesive disposed between at least a portion of the body and the barrier layer; and a penetration at least partially disposed within an opening disposed through the sheathing assembly, wherein the penetration includes a contact member, and wherein at least a portion of the contact member is disposed between the body and the barrier layer.

20. The building structure according to paragraph 19, wherein at least a portion of the contact member is disposed on a side of the barrier layer opposite the adhesive.

21. The building structure according to paragraphs 19 or 20, wherein the contact member is integral with at least a portion of the penetration.

22. The building structure of according to any one of paragraphs 19 to 21, further comprising at least one of one or more pieces of flashing disposed along at least a portion of the opening, such that the flashing covers at least a portion of the frame and the barrier layer; one or more pieces of flashing disposed along at least a portion of the contact member and the barrier, such that the flashing covers at least a portion of the contact member and the barrier layer; and one or more pieces of flashing disposed along at least a portion of the contact member and between the body and the barrier layer, such that the flashing covers at least a portion of the contact member and the body beneath the barrier layer.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for installing a penetration in a sheathing assembly, comprising:

forming an opening at least partially through a sheathing assembly, the sheathing assembly comprising:

a body, wherein the body comprises wood, engineered wood, or a combination thereof;

a barrier layer; and an adhesive disposed between at least a portion of the body and the barrier layer, wherein the adhesive has a bond strength that permits the barrier layer to be peeled from the body;

peeling at least a portion of the barrier layer from the body, adjacent the opening to expose at least a portion of the body;

disposing a penetration at least partially within the opening, wherein the penetration at least partially contacts the exposed portion of the body;

securing the penetration to at least a portion of the sheathing assembly; and repositioning the peeled portion of the barrier layer such that the barrier layer covers at least a portion of the penetration.

2. The method of claim 1, wherein the opening is formed completely through the sheathing assembly.

3. The method of claim 1, wherein the body comprises oriented strand board.

4. The method of claim 1, wherein the barrier layer comprises a cross-woven polyolefin wrap that provides a water and air resistant barrier.

5. The method of claim 1, wherein the penetration includes a window frame, door frame, chimney, cable, wire, pipe, duct, exhaust fan, exhaust vent, mail box, mail box slot, central air conditioning line, central air conditioning tubing, electrical box, electrical outlet, light fixture, speaker fixture, skylight, or any combination thereof.

6. The method of claim 1, wherein peeling the barrier layer includes scoring the barrier layer in two or more locations to provide a section of the barrier layer that is to be peeled.

7. The method of claim 1, further comprising disposing flashing along at least a portion of the penetration and the barrier layer, such that the flashing covers at least a portion of the penetration and the barrier layer.

8. The method of claim 1, further comprising disposing the sheathing assembly on a frame structure, wherein the body faces the frame structure.

9. The method of claim 1, further comprising:

disposing flashing along at least a portion of the opening, such that the flashing covers at least a portion of a frame structure and the barrier layer;

disposing flashing along at least a portion of the penetration and the barrier layer, such that the flashing covers at least a portion of the penetration and the barrier layer;

disposing flashing along at least a portion of the penetration and the exposed body, such that the flashing covers at least a portion of the penetration and the exposed body; or any combination thereof.

10. The method of claim 1, wherein the sheathing assembly is oriented such that the barrier layer faces toward the exterior of the frame structure.

11. The method of claim 1, wherein the penetration is at least partially disposed within the opening before the portion of the barrier layer is peeled.

12. A method for installing a penetration in a sheathing assembly, comprising:

disposing one or more sheathing assemblies on an exterior side of a frame to provide a supported sheathing assembly, wherein the one or more sheathing assemblies comprise:

a body, wherein the body comprises wood, engineered wood, or a combination thereof;

a barrier layer; and an adhesive disposed between at least a portion of the body and the barrier layer, wherein the adhesive permits separation of the barrier layer from the body;

forming an opening at least partially through the supported sheathing assembly;

peeling back a portion of the barrier layer from the body, adjacent the opening to expose a portion of the body;

disposing flashing along a portion of the opening, such that the flashing contacts the barrier layer and the frame;

disposing a penetration at least partially within the opening, wherein the penetration includes a contact member that at least partially contacts the exposed portion of the body;

securing the penetration to the supported sheathing assembly; and repositioning the peeled back portion of the barrier layer, such that the peeled back portion of the barrier layer overlaps at least a portion of the contact member.

13. The method of claim 12, further comprising scoring the barrier layer at one or more locations prior to peeling back the portion of the barrier layer.

14. The method of claim 12, further comprising disposing one or more pieces of tape along the one or more scored locations.

15. The method of claim 12, further comprising disposing one or more pieces of flashing about the penetration and the supported sheathing assembly, such that at least a portion of the flashing covers at least a portion of the contact member, the exposed body, or both.

16. The method of claim 12, further comprising disposing one or more pieces of flashing about the penetration and the supported sheathing assembly, such that at least a portion of the flashing covers at least a portion of the contact member, the barrier layer, or both.

17. The method of claim 12, wherein the penetration is at least partially disposed within the opening before the portion of the barrier layer is peeled back.

18. A building structure, comprising:

a framed structure;

one or more sheathing assemblies disposed on an exterior side of the framed structure, wherein the one or more sheathing assemblies comprise:

a body;

a barrier layer; and an adhesive disposed between at least a portion of the body and the barrier layer, wherein the adhesive permits separation of the barrier layer from the body; and a penetration at least partially disposed within an opening disposed through the sheathing assembly, wherein the penetration includes a contact member, and wherein at least a portion of the contact member is disposed between the body and the barrier layer.

19. The building structure of claim 18, wherein at least a portion of the contact member is disposed on a side of the barrier layer opposite the adhesive.

20. The building structure of claim 18, wherein the contact member is integral with at least a portion of the penetration.

21. The building structure of claim 18, further comprising at least one of one or more pieces of flashing disposed along at least a portion of the opening, such that the flashing covers at least a portion of the frame and the barrier layer; one or more pieces of flashing disposed along at least a portion of the contact member and the barrier, such that the flashing covers at least a portion of the contact member and the barrier layer; and one or more pieces of flashing disposed along at least a portion of the contact member and between the body and the barrier layer, such that the flashing covers at least a portion of the contact member and the body beneath the barrier layer.

22. The method of claim 1, wherein peeling at least a portion of the barrier layer requires a peel strength ranging from about 0.0009 kgf/cm to about 0.45 kgf/cm in accordance with ASTM D6862.

* * * * *